US008863859B2

(12) United States Patent
Koch et al.

(10) Patent No.: US 8,863,859 B2
(45) Date of Patent: Oct. 21, 2014

(54) METHOD FOR DETERMINING THE WEAR OF A FORCE-LOADED LINKAGE OF AN EARTH-WORKING DEVICE

(75) Inventors: Elmar Koch, Eslohe (DE); Sebastian Fischer, Lennestadt (DE)

(73) Assignee: Tracto-Technik GmbH & Co. KG, Lennestadt (DE)

( * ) Notice: Subject to any disclaimer, the term of this patent is extended or adjusted under 35 U.S.C. 154(b) by 604 days.

(21) Appl. No.: 13/125,480

(22) PCT Filed: Oct. 21, 2009

(86) PCT No.: PCT/EP2009/007539

§ 371 (c)(1),
(2), (4) Date: Sep. 8, 2011

(87) PCT Pub. No.: WO2010/046099

PCT Pub. Date: Apr. 29, 2010

(65) Prior Publication Data

US 2012/0138320 A1 Jun. 7, 2012

(30) Foreign Application Priority Data

Oct. 21, 2008 (DE) ..... 10 2008 052 510

(51) Int. Cl.
*E21B 47/00* (2012.01)
*E21B 47/01* (2012.01)

(52) U.S. Cl.
CPC ..... *E21B 47/0006* (2013.01); *E21B 47/01* (2013.01)
USPC ..... 175/39

(58) Field of Classification Search
USPC ..... 701/40, 50; 73/152.49, 152.51, 152.54, 73/152.48, 152.59, 862.045, 862.041; 175/39, 40, 48, 25, 218, 231, 232; 367/85; 166/250.01, 250.1; 702/6, 9, 702/41, 42, 43; 37/196, 197, 348, 195, 466; 172/2–11
See application file for complete search history.

(56) References Cited

U.S. PATENT DOCUMENTS

| | | | | |
|---|---|---|---|---|
| 4,359,898 A | | 11/1982 | Tanguy et al. | |
| 4,627,276 A | * | 12/1986 | Burgess et al. | 73/152.44 |
| 4,715,451 A | | 12/1987 | Bseisu et al. | |
| 4,876,886 A | * | 10/1989 | Bible et al. | 73/152.45 |
| 5,202,680 A | | 4/1993 | Savage | |

(Continued)

FOREIGN PATENT DOCUMENTS

| | | |
|---|---|---|
| EP | 0 054 475 A1 | 6/1982 |
| WO | WO 2010/148286 A2 | 12/2010 |
| WO | WO2011/014815 A1 | 2/2011 |

OTHER PUBLICATIONS

M. Amro: "Equations predict drill-pipe fatigue in Middle East operations", in: Oil and Gas Journal, vol. 98, No. 28, Jul. 10, 2000.

(Continued)

*Primary Examiner* — Robert Pezzuto
(74) *Attorney, Agent, or Firm* — Howard IP Law Group, PC

(57) ABSTRACT

The invention relates to a method for determining the wear of a force-loaded linkage of an earthwork device, wherein the instantaneous load on the linkage is measured during operation of the earthwork device and used to perform a calculation of the service life.

22 Claims, 2 Drawing Sheets

(56) References Cited

U.S. PATENT DOCUMENTS

| | | | | |
|---|---|---|---|---|
| 5,347,859 | A | 9/1994 | Henneuse et al. | |
| 7,357,197 | B2 * | 4/2008 | Schultz et al. | 175/39 |
| 7,775,099 | B2 * | 8/2010 | Bogath et al. | 73/152.49 |
| 2009/0050368 | A1 | 2/2009 | Griffin et al. | |

OTHER PUBLICATIONS

J. Wu: "Model predicts drill pipe fatigue in horizontal wells", in: Oil and gas Journal, vol. 95, No. 5, Feb. 3, 1997.

* cited by examiner

METHOD FOR DETERMINING THE WEAR OF A FORCE-LOADED LINKAGE OF AN EARTH-WORKING DEVICE

CROSS-REFERENCES TO RELATED APPLICATIONS

This application is the U.S. National Stage of International Application No. PCT/EP2009/007539, filed Oct. 21, 2009, which designated the United States and has been published as International Publication No. WO 2010/046099 and which claims the priority of German Patent Application, Serial No. 10 2008 052 510.3, filed Oct. 21, 2008, pursuant to 35 U.S.C. 119(a)-(d).

BACKGROUND OF THE INVENTION

The invention relates to a method for determining wear of a force-loaded linkage of an earth-working device and an earth-working device configured for carrying out the method.

Earth-working devices, for example (horizontal) drilling apparatuses and apparatuses for rehabilitating already existing channels in the ground (bores, old pipes), for example expansion devices and pipe pulling devices, typically include a drive apparatus and a linkage, to which the corresponding tool (e.g., the drill head, expansion head or pipe pulling adapter) is attached, connected to the drive apparatus. The drive forces from the drive apparatus are transferred by the linkage to the tool, whereby the tool is advanced in the ground. Pressing forces are typically applied to the tool (the drill head) for a drilling operation of the earth-working device, so that the tool is pushed through the ground. Conversely, pulling forces are typically applied when widening existing bores, bursting existing old pipes and pulling new pipes into existing bores or old pipes. If only pulling forces need to be transmitted, i.e., in an earth-working device which is only used for widening, then cables or chains can also be used as pulling means instead of a linkage. The linkage of an earth-working device consists generally of a plurality of interconnected rod sections which are sequentially connected with each other (in a pushing operation) commensurate with the advance of the tool in the ground or detached from each other (in a pulling operation). The rod sections can be connected, for example, via threaded connections or plug-in couplings. When transmitting the drive forces to the tool with a linkage, only linear drives are employed, which transfer the drive forces and/or drive movements stepwise to the linkage, i.e., with a load stroke, where the linkage is connected with the linear drive, and an idle stroke, wherein the connection between the linear drive and the linkage is released. All conventional linear drives for earth-working devices operate with hydraulic cylinders as drive source, because these are able to produce the large forces while having comparatively compact dimensions. However, linear drives with rack and pinion drives are also known.

If only pulling forces are to be transmitted (in particular, if additional use as drilling device is not contemplated), then pull cables or chains can also be used for transmitting the drive forces to the tool. The pull cables or chains can either also cooperate with the linear drive, which then must have corresponding clamping elements for affixing the pull cable or chain, or may be used with (hydraulic) winches.

A problem has surfaced during use of the aforedescribed earth-working devices in that the expected service life of fundamentally all components of this device, however in particular of the force transmitting element (i.e., the linkage, the pull cable or the chain), is difficult to estimate. This is particularly due to the fact that the service life of the components depends on how the load is applied, in addition to the geometric dimensions and the employed material. In particular, the magnitude of the applied forces and the fraction of dynamic loads to the total load affect the service life of the components. The fraction and the magnitude of the dynamic, i.e., non-static loads (i.e., loads with a constant force from a constant direction) in earth-working devices depend in turn significantly on the external circumstances (e.g., the conditions of the ground) and the employed drive apparatus. In addition, the time at which a rod section is inserted in the strand of a linkage, has a significant effect on the loads to which this rod section is subjected during the performed earthwork, and hence on the service life of this rod section.

The loads on the linkage cause material fatigue which increases with the fraction and the magnitude of the dynamic loads on the total loads. Material fatigue can cause cracks at geometric weak points (e.g., notches or other transitions in the cross-section) and material-related flaws (e.g., material inclusions), which propagate with progressing rocker number of the dynamic loads and finally result in failure of the linkage due to breakage or tearing. This can be associated with a significant safety risk for the operating personnel of the earth-working device, if a rod section which is still in the working draft fails, or can lead to additional work, in particular when the cracked rod section can only be retrieved by digging.

A number of computation methods have been developed to calculate an expected service life of a dynamically loaded component, wherein particularly the magnitude of the loads and the frequency of the occurrence of these loads is evaluated—in addition to the geometric dimensions and the employed material of the respective component—and used for estimating the expected service life.

Starting from the current state-of-the-art, it was an object of the invention to increase the operating safety of an earth-working device of this type.

SUMMARY OF THE INVENTION

This object is attained by the subject matter of the independent claims. Advantageous embodiments are recited in the corresponding dependent claims and can also be inferred from the following description of the invention.

The core of the invention suggests to measure the instantaneous load on the linkage of an earth-working device during the operation of this earth-working device and to use the results of this measurement for performing a service life calculation.

Measuring the actual load during operation has significant advantages compared to conventional load tests performed under laboratory conditions, because the measured values will always be significantly more accurate than simulations under laboratory conditions.

Accordingly, the earth-working device according to the invention has a drive apparatus and a linkage connected to the drive apparatus, where in the linkage is force-loaded by the drive apparatus. The earth-working device also includes a measuring device for measuring the instantaneous load on the linkage during operation as well as an evaluation device for performing a service life calculation for the linkage.

"Earth-working devices" are intended to refer to all devices where forces are transmitted from a drive apparatus via a force-transmitting element to a tool, which is thereby moved in the ground or in a hollow space (e.g., a bore or an old pipe) in the ground.

"Linkages" refers within the context of the invention not only to rigid linkages composed of interconnected rod sections, but more particularly to all force-transmitting elements that can be employed with an earth-working device according to the invention. These may also include, in particular, pull cables and chains. In addition, the term "linkage" according to the invention is intended to refer not only to the force-transmitting element arranged between the drive apparatus of the earth-working device and a tool, but in general to all components of a load strand of the earth-working device that are subjected to a load resulting from forces and/or torques generated by the drive apparatus. Included are here particularly the respective tool of the earth-working device itself or components thereof.

The evaluation device may, for example, include a counter for determining the position and/or for determining the number of loadings.

In a preferred embodiment, the sum of the instantaneous loads during the operation of the earth-working device is measured and the loads of previous uses of the earth-working device are taken into consideration when performing the service life calculation. This provides particularly accurate information about the ageing state of the linkage.

In a preferred embodiment, the measured load and/or the result of the service life calculation is stored. The results of the service life calculation can then be updated after each use of the linkage and hence be precisely outputted. The earth-working device according to the invention has for this purpose preferably a storage device for storing the measured loads and/or the result of the service life calculation.

In another preferred embodiment of the present invention, the operating forces of a drive apparatus connected with the linkage are measured for determining the instantaneous load of the linkage. Such measurement of the operating forces of the drive apparatus can typically be easily performed, for example by measuring the hydraulic pressure in the hydraulic cylinders of a linear drive and converting the measured value into a value for the force with which the linkage is loaded. Ageing of the linkage and/or the remaining service life can be determined from the determined operating forces. To this end, the earth-working device according to the invention has preferably a measuring device arranged on the drive apparatus.

Preferably, the evaluation device can also be arranged on the drive apparatus.

The method according to the invention is particularly suited for determining the wear of a linkage which includes a plurality of interconnected rod sections. Preferably, the individual loads of individual or of all the rod sections are measured and individual service life calculations are performed. This can again significantly increase the accuracy of the performed service life calculations. One particular reason is that in a load event, i.e., when performing a close-ended work project (e.g., a bore, a bursting operation or a pipe pulling operation) the individual rod sections are under load for different lengths of time depending on the time when they are inserted into the linkage strand. The individual rod sections are additionally used with many different work projects, wherein it is typically difficult to reconstruct which rod section was used in which work project and how long the rod section was under load. It has thus so far not been possible to determine for how long an individual rod section has already been under load in order to estimate the service life of this actual rod section based on service life calculations performed in a laboratory. This now becomes feasible owing to the preferred individual measurement of the loads on the individual rod sections according to the invention and the corresponding evaluation. To this end, the values for the individual rod sections are preferably stored separately, which can preferably be done in a storage element that is itself connected with the respective rod section. By providing individual or all rod sections with corresponding storage elements, it can be prevented that the individual measurements and service life calculations are mixed up. In addition, complex data management is eliminated when the different rod sections are intermixed for the different work projects and employed at different work sites.

However, the values for the individual rod sections may also be centrally stored, wherein each rod section has an identifiable code (e.g., the serial number of the rod section which is, for example, determined optically), which is then associated with the centrally stored values.

Preferably, the measured loads and/or the individual service life calculations of a load event may be transmitted from the drive apparatus to the individual storage elements. This may preferably take place when the corresponding rod section is in the drive apparatus for insertion in or detachment from the linkage strand. To this end, a transmission device is provided in the drive apparatus which is used to transmit the measured loads and/or the results of the service life calculations to the storage elements of the rod sections. The transmission devices are preferably arranged in the drive apparatus.

In a particularly preferred embodiment in a linkage subjected to pull, which includes a plurality of interconnected rod sections, the measured loads and/or individual service life calculations of a load event can be transmitted when the linkage is stepwise pulled with the drive apparatus through a bore in the ground, wherein the individual rod sections are sequentially pulled from the bore and detached from the rest of the linkage, by transmitting the loads or results of the service life calculations to the storage element of the rod section to be detached shortly before detachment, during the detachment of the rod section or shortly thereafter, in particular as long as the rod section is in the range of the drive apparatus.

In order to be able to include in the service life calculations also those loads, to which the individual rod sections were subjected in previous load events, the loads and/or the results of the service life calculations stored in the storage elements of the individual rod sections may be initially transmitted to the drive apparatus and subsequently updated in the drive apparatus with the loads (e.g. the number of work strokes with the corresponding force values) and/or the service life calculations of the previous load event, whereafter the updated values are stored again in the storage elements. In this way, ageing of the individual rod sections at the current worksite can be reconciled with those at the previous work sites.

With respect to the device, a receiving device is preferably provided which is configured to read out from the storage elements the data relating to the previous loads and/or the previous results of the service life computations. The receiving device can hereby be an active device, i.e., it reads the data stored in a passive storage element. Alternatively, the receiving device can also cooperate with active storage elements which transmit the desired values to the receiving device.

In a particularly preferred embodiment, the transmitting and/or receiving device operates wirelessly, for example with any type of data transmission technologies (e.g., with electromagnetic waves (e.g., radio), infrared data transmission, etc.). Wireless within the context of the invention is to be understood as any contactless transmission of data.

The invention also relates to a rod section of a linkage of an earth-working device which includes a storage element and information relating to the loads to which the rod section was subjected stored on the storage element.

The core idea of the invention is fundamentally suited for determining the wear of all devices having a service life which is difficult to estimate due to strongly varying loads.

The invention will now be described in more detail with reference to an exemplary embodiment illustrated in the drawings.

DETAILED DESCRIPTION OF PREFERRED EMBODIMENTS

Figure 1:
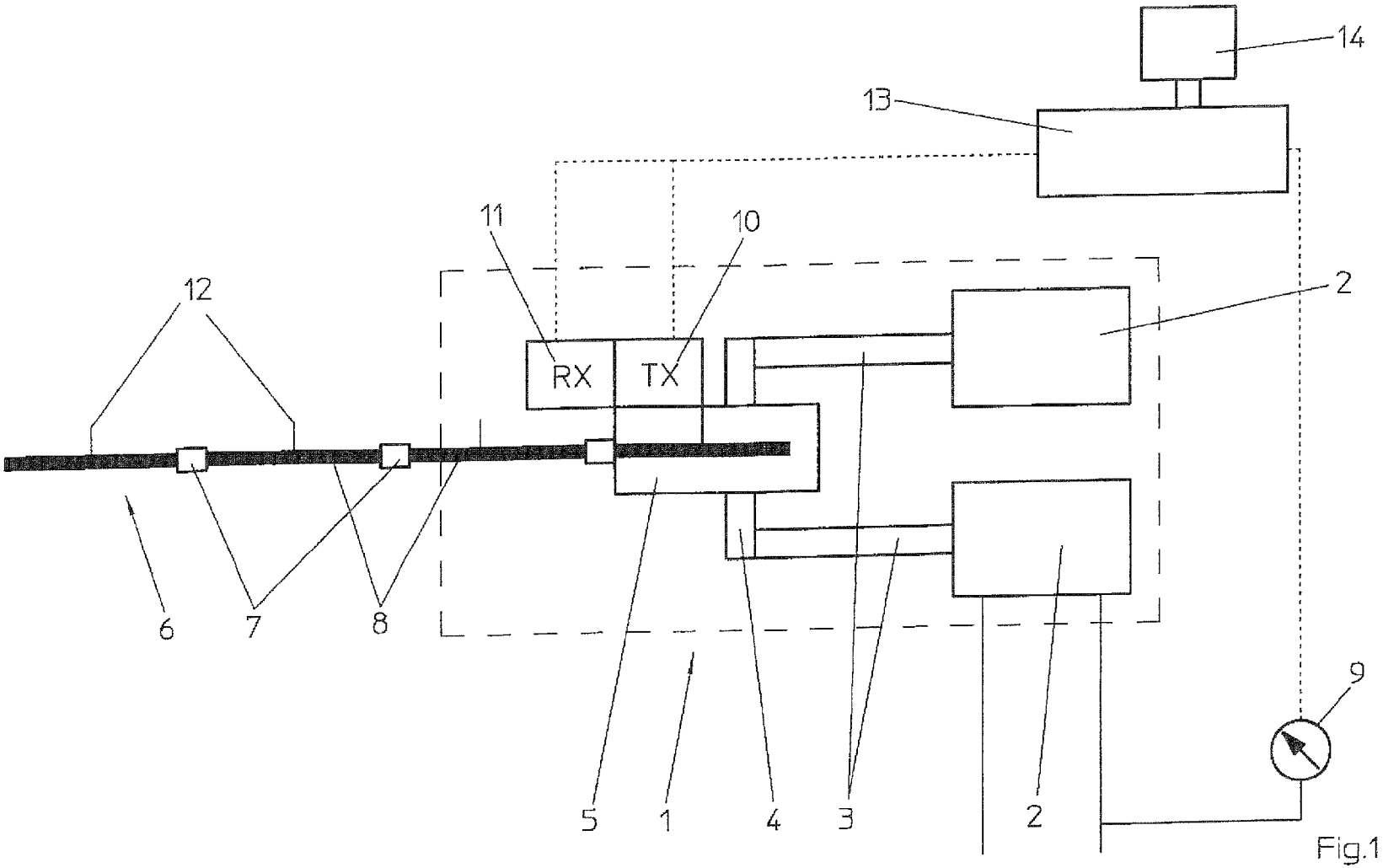
FIG. 1 an earth-working device according to the invention in a schematic diagram.

FIG. 1 shows in form of a schematic diagram an earth-working device according to the invention with its important components. The earth-working device includes a drive apparatus 1 with two hydraulic cylinders 2 operated in parallel, wherein the associated piston rod 3 transmits via a pressure bridge 4 and a coupling element 5 connected thereto a linear motion to a linkage 6 of the earth-working device. The transmission occurs stepwise, wherein the hydraulic cylinder 2 of the drive apparatus 1 performs cyclically a corresponding work stroke and a corresponding idle stroke.

The illustrated drive apparatus is suitable for both pushing and pulling operation. This makes it possible, for example, to initially introduce in pushing operation a pilot bore into the ground (not shown) starting from an (unillustrated) start shaft in the ground, whereby the linkage 6 of the earth-working device is stepwise advanced into the ground. After each work stroke of the drive apparatus 1, the linkage 6, which is composed of a plurality of rod sections 8 connected by way of quick connects 7, is extended by a new rod section 8. As soon as the drill head (not shown), which in the earth-working device of FIG. 1 would be attached on the left, i.e., during the drilling operation front, end of the linkage, reaches a destination shaft (not shown), the pilot bore is finished and the drill head is exchanged against an expansion head ("back reamer", which is also not shown), to which an (unillustrated) new pipe to be pulled in may also be directly attached. In the subsequent pulling operation of the drive apparatus 1, the expansion head, and, if applicable, also the new pipe to be pulled in, can be pulled in the direction of the start shaft, whereby the rod sections 8 of the linkage entering the start shaft are sequentially detached.

According to the invention, the earth-working device illustrated in FIG. 1 includes a measuring device for measuring the instantaneous load on the linkage as well as an evaluation unit for performing a service life calculation for the linkage. The actual earth-working device also includes a pressure sensor 9 configured to measure the hydraulic pressure in one or both of the hydraulic cylinders 2. The measured hydraulic pressure which is proportional to the pressure or pulling forces applied on the linkage 6 is transmitted to a computing unit 13 (CPU). The earth-working device according to the invention additionally includes a transmission device 10 and a receiving device 11, via which the data can be wirelessly transmitted to and/or received from RFID chips 12 (RFID: Radio Frequency Identification), with a corresponding RFID chip 12 attached on each of the rod sections 8. Both the transmission device 10 and the receiving device 11 are connected with the computing unit 13.

With the earth-working device according to the invention, the individual loads to which the individual rod sections 8 are subjected can be determined and individual service life calculations can be performed therefrom. To this end, the data stored on the corresponding RFID chip 12 (including, if applicable, also data from previous uses of this rod section 8) are read out with the receiving device 11 for each of the rod sections 8 before they are detached and after widening the pilot bore. During the elapsed time between attachment and detachment of the individual rod sections 8, a defined number of work strokes is applied to the linkage 6 and the corresponding rod section 8 via the drive apparatus 1, wherein the magnitude of the corresponding applied loads can be determined with the pressure sensor 9. Based on these concrete values, an individual service life calculation can be performed in the computing unit 13 for each individual rod section 8 of the linkage 6. The result of this service life calculation, wherein previous loads on the respective rod section 8 are also taken into consideration in addition to loads from to the current work project, is stored via the transmitting device 10 again on the RFID chip 12 of the corresponding rod section 8, so that the data are once more available for a subsequent use of the corresponding rod segment 8 and can be considered in an additional update of the service life circulation.

A corresponding service life calculation is performed for each of the rod sections 8 of the linkage 6, because different results are obtained for all the rod sections 8, depending on the position where they are inserted in the linkage 6. For example, the first rod section 8 of the linkage, which is directly connected with the drill head or the expansion head, is under load for the longest time, because it is the first rod section attached when the pilot bore is established and the last rod section detached after widening and, if applicable, pulling in the new pipe. The loads on this rod section 8 are therefore significantly greater than, for example, on the rod segment 8 that was attached last and was therefore also detached last.

The following data are stored on the RFID chip 12 of each rod section 8:

Production order number,
Average pressure,
Crack test yes/no,
Lifetime wear,
Total number of strokes,
Number of strokes for each stress level (8×),
Total damage to date,
Most damaging stress level,
Expected service life under full load,
Expected service life under average load.

The earth-working device illustrated in FIG. 1 is also equipped with a display screen 14, on which the result of the service life calculation in the form stored on the corresponding RFID chip 12 when each rod section 8 was detached is displayed. This enables the operator of the earth-working device to read out the displayed information relating to the expected service life for the corresponding rod section 8. For example, rod sections 8 having an expected service life that is insufficient for a subsequent use can be immediately sorted out. In addition, the individual rod sections 8 can be sorted according to their expected service life after detachment and stored accordingly. In this way, those rod sections 8 having only a short expected service life can be attached late to the linkage so as to be able to keep additional loads on these rod sections 8 small and to quickly and easily retrieve the respective rod section in the event it is destroyed.

In addition, a portable handing device may be provided which has at least a corresponding receiving device and a display. With this portable handing device, the RFID chips 12 of stored rod sections 8 can be read out independent of the drive apparatus 1 to facilitate planning of future use of the individual rod sections 8. The read out values may be used, for example, for inventory control or for generating lease lists, etc.

Figure 2:
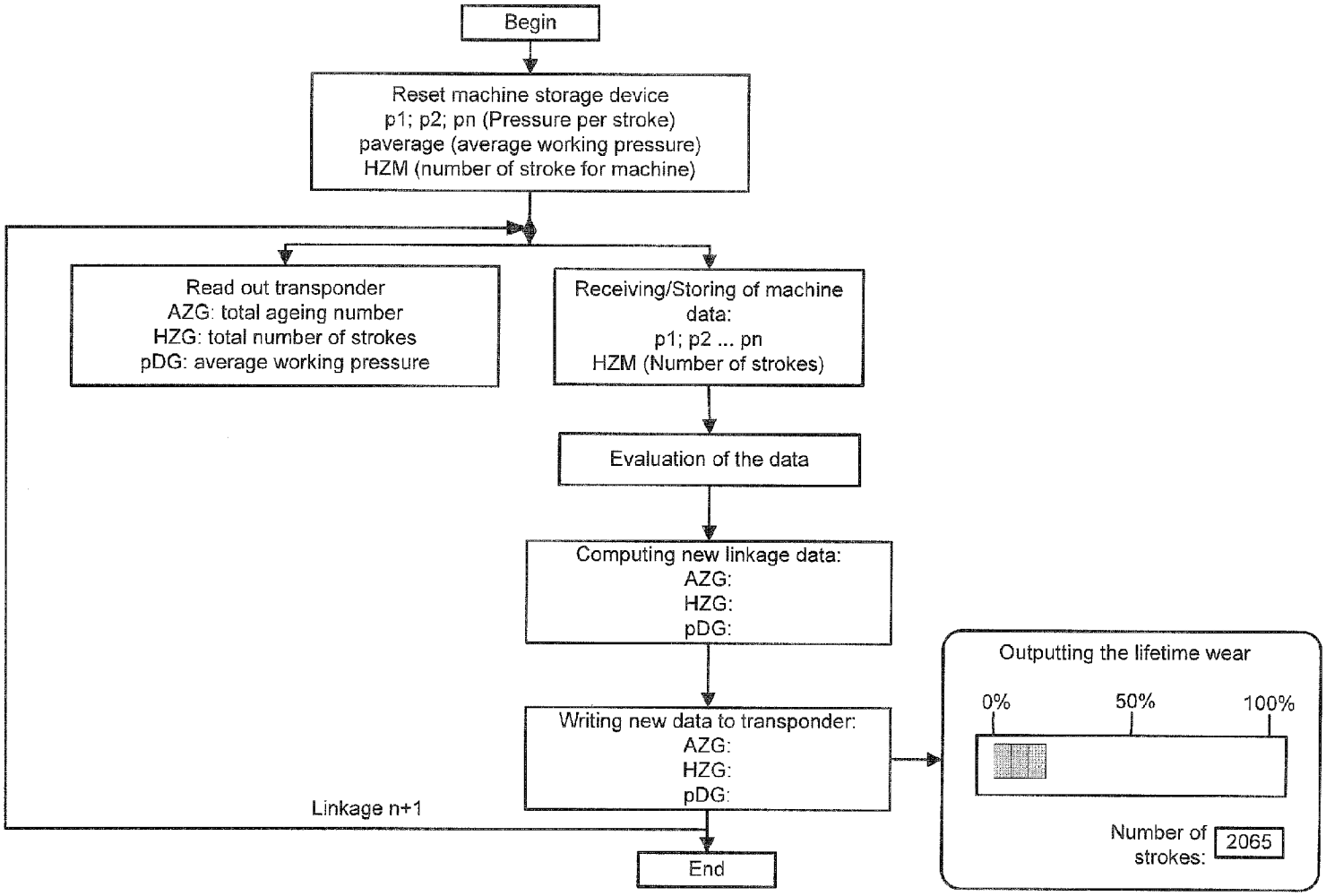
FIG. 2 a method according to the invention for determining the wear of a rod section in a schematic diagram.

FIG. 2 shows a schematic process flow diagram of a service life calculation which can be performed in the computing unit 13 of the earth-working device of FIG. 1. Before the earth-working device is employed, the machine storage device, i.e., the data stored in the computing unit from a previous work project, is erased. Thereafter, the first of the rod sections 8 is inserted in the drive apparatus 1. The drive apparatus 1 is then started up and the corresponding work operations are performed. The corresponding machine data are here measured with the pressure sensor 9 and stored in the computing unit 13. Actually, the pressure sensor 9 measures the hydraulic pressure for each work stroke of the hydraulic cylinders 2. In addition, the number of strokes can be determined by evaluating the pressure curve measured by the pressure sensor 9. The data measured by the pressure sensor 9 are evaluated in the computing unit 13 and changed values for the linkage data (total ageing number (AZG), total number of strokes (HZG) and average working pressure (pDG)) are calculated. When the corresponding rod section 8 has again reached the drive apparatus during pulling operation of the drive apparatus and can be detached, the data already stored on the RFID chip 12 relating to the previous work projects are read out, with the following data being read out: total ageing number (AZG), total number of strokes (HZG) and average working pressure (pDG). The read out linkage data are then reconciled with the calculated new linkage data and stored again on the RFID chip 12 via the transmission device 10. To inform the operator of the earth-working device, the result of the service life calculation are displayed on the display screen 14; this may take the form of, for example, displaying the percentage of the used-up service life of the corresponding rod section 8 and the number of strokes still to be expected for this rod section 8 under average load.

In the aforedescribed embodiment of the method of the invention, the new linkage data are read out as well as calculated and transmitted again to the RFID chip 12 of the corresponding rod section 8 shortly before or during the detachment of the rod section 8. In this way, the calculation is always performed for the correct rod section 8.

It may also be feasible to display the linkage data also when the rod section 8 is inserted in the drive apparatus when establishing the pilot bore, thus enabling continuous monitoring that no "worn out" rod section 8 is used.

It will be understood that not only pushing and pulling forces, but for example also torsion forces, torques, bending moments and rotation speeds, may be taken into account in the measurement of the instantaneous load and a service life calculation based thereon.

A corresponding service life calculation is performed individually for each of the rod sections of the linkage.

The invention claimed is:

1. A method for determining wear of a force-loaded linkage of an earth-working device, comprising the steps of:

measuring an instantaneous load on the linkage during the operation of the earth-working device, accessing at least one of a stored service life calculation and stored instantaneous load data for the linkage; and determining an updated service life calculation for the linkage based on the measured instantaneous load on the linkage and the at least one of the stored service life calculation and stored instantaneous load data for the linkage.

2. The method of claim 1, wherein measuring an instantaneous load comprises measuring a sum of instantaneous loads during the operation of the earth-working device, and further comprising taking into consideration the loads of previous usages of the earth-working device when performing the service life calculation.

3. The method of claim 1, further comprising the step of storing at least one of the measured load and a result of the service life calculation.

4. The method of claim 1, further comprising measuring operating forces of a drive apparatus connected with the linkage.

5. The method of claim 1, wherein the linkage comprises a plurality of interconnected rod sections, the method further comprising the steps of:

measuring individual loads of at least one rod section, and performing individual service life calculations on the individual loads for the measured rod sections.

6. The method of claim 5, wherein one or more of the individual loads and the results of the individual service life calculations, are stored in storage elements connected with the individual rod sections.

7. The method of claim 6, wherein a measured load of a load event is transmitted from a drive apparatus to the individual storage elements.

8. The method of claim 7, wherein the linkage is pulled stepwise by the drive apparatus through a bore in the ground, wherein individual rod sections are sequentially pulled from the bore and detached from the rest of the linkage, and wherein the measured loads or results of the service life calculations are transmitted to a storage element disposed on an individual rod section when the rod section is in range of the drive apparatus.

9. The method of claim 6, further comprising the steps of:

transmitting the loads or the results of the service life calculations, or both, stored on the storage elements to a drive apparatus, updating one or more of the transmitted loads and the results of the service life calculations in the drive apparatus with the corresponding loads and service life calculations of a most recent load event, and storing one or more of the updated loads and the results in the storage element.

10. The method of claim 7, wherein the transmission is wireless.

11. The method of claim 9, wherein the transmission is wireless.

12. An earth-working device comprising:

a drive apparatus, a linkage connected with the drive apparatus, wherein the linkage is force-loaded by the drive apparatus, a measuring device for measuring an instantaneous load on the linkage, and an evaluation unit for accessing at least one of a stored service life calculation and stored instantaneous load data for the linkage; and determining an updated service life calculation for the linkage based on the at least one of the stored service life calculation and the stored instantaneous load data for the linkage and the measured instantaneous load on the linkage.

13. The earth-working device of claim 12, further comprising a storage device for storing at least one of the measured instantaneous load and a result of the service life calculation.

14. The earth-working device of claim 12, wherein the measuring device or the evaluation device, or both, are arranged on the drive apparatus.

15. The earth-working device of claim 12, wherein the linkage comprises a plurality of interconnected rod sections, wherein the individual load of at least one rod section is measured and individual service life calculations are performed for each measured rod section.

16. The earth-working device of claim 15, further comprising storage elements connected with the individual rod sections in one-to-one correspondence.

17. The earth-working device of claim 16, further comprising a transmission device for transmitting one or more of the measured loads and the results of the service life calculations to the storage elements.

18. The earth-working device of claim 16, further comprising a receiving device for reading out at least one of the measured loads and the results of the service life calculations stored on the storage devices.

19. The earth-working device of claim 17, wherein the transmission device operates wirelessly.

20. The earth-working device of claim 18, wherein the receiving device operates wirelessly.

21. The earth-working device of claim 12, wherein the evaluation unit is further for, in determining the updated service life calculation, determining an expected service life of the linkage.

22. The earth-working device of claim 21, wherein the evaluation unit is further for, in determining the updated service life calculation, determining an expected service life of the linkage under average load and determining an expected service life of the linkage under full load.

* * * * *